US006589105B2

(12) United States Patent
Young et al.

(10) Patent No.: US 6,589,105 B2
(45) Date of Patent: Jul. 8, 2003

(54) PAD TENSIONING METHOD AND SYSTEM IN A BI-DIRECTIONAL LINEAR POLISHER

(75) Inventors: Douglas W. Young, Sunnyvale, CA (US); Vulf Perlov, Cupertino, CA (US); Efrain Velazquez, San Jose, CA (US)

(73) Assignee: Nutool, Inc., Milpitas, CA (US)

( * ) Notice: Subject to any disclaimer, the term of this patent is extended or adjusted under 35 U.S.C. 154(b) by 0 days.

(21) Appl. No.: 10/126,464

(22) Filed: Apr. 18, 2002

(65) Prior Publication Data

US 2003/0022599 A1 Jan. 30, 2003

Related U.S. Application Data

(63) Continuation-in-part of application No. 09/880,730, filed on Jun. 12, 2001, now Pat. No. 6,464,571, which is a continuation-in-part of application No. 09/684,059, filed on Oct. 6, 2000, now Pat. No. 6,468,139, which is a continuation-in-part of application No. 09/576,064, filed on May 22, 2000, now Pat. No. 6,207,572, which is a continuation of application No. 09/201,928, filed on Dec. 1, 1998, now Pat. No. 6,103,628.

(51) Int. Cl.[7] ..... B24B 21/00
(52) U.S. Cl. ..... 451/296; 451/168; 451/312
(58) Field of Search ..... 451/11, 41, 296–298, 451/302–304, 168, 312

(56) References Cited

U.S. PATENT DOCUMENTS 6,068,542 A * 5/2000 Hosokai ..... 451/37
6,110,025 A * 8/2000 Williams et al. ..... 451/286
6,113,479 A * 9/2000 Sinclair et al. ..... 451/288
6,129,540 A * 10/2000 Hoopman et al. ..... 425/373
6,135,859 A * 10/2000 Tietz ..... 451/41
6,136,715 A * 10/2000 Shendon et al. ..... 438/692
6,179,690 B1 * 1/2001 Talieh ..... 451/41
6,179,709 B1 * 1/2001 Redeker et al. ..... 451/6
6,241,583 B1 * 6/2001 White ..... 451/41
6,302,767 B1 * 10/2001 Tietz ..... 451/41
6,312,319 B1 * 11/2001 Donohue et al. ..... 451/56
6,379,231 B1 * 4/2002 Birang et al. ..... 451/296
6,413,873 B1 * 7/2002 Li et al. ..... 438/711

* cited by examiner

*Primary Examiner*—Joseph J. Hail, III
*Assistant Examiner*—David B. Thomas
(74) *Attorney, Agent, or Firm*—Pillsbury Winthrop LLP

(57) ABSTRACT

The present invention describes a chemical mechanical polishing apparatus and method that uses a portion of a polishing pad that is disposed under tension between a supply spool and a receive spool, with a motor providing the tension to either the supply spool or the receive spool and the other spool being locked during processing. If a new section of the polishing pad is needed, the same motor that provided the tension is used to advance the polishing pad a determined amount. Further, during processing, a feedback mechanism is used to ensure that the tension of the polishing pad is consistently maintained.

21 Claims, 7 Drawing Sheets

PAD TENSIONING METHOD AND SYSTEM IN A BI-DIRECTIONAL LINEAR POLISHER

This application is a continuation-in-part of and claims the benefit of priority under 35 USC 119/120 to the following:

application Ser. No. 09/880,730 filed Jun. 12, 2001, now U.S. Pat. No. 6,464,571 entitled "Polishing Apparatus and Method With Belt Drive System Adapted to Extend the Lifetime of a Refreshing Polishing Belt Provided Therein", which is a continuation-in-part of:

application Ser. No. 09/684,059 filed Oct. 6, 2000, now U.S. Pat. No. 6,468,139 entitled "Chemical Mechanical Polishing Apparatus and Method with Loadable Housing", which is a continuation-in-part of:

Application Ser. No. 09/576,064 filed May 22, 2000, Now U.S. Pat. No. 6,207,572 entitled "Reverse Linear Chemical Mechanical Polisher with Loadable Housing", which is a continuation of:

application Ser. No. 09/201,928 filed Dec. 1, 1998, Now U.S. Pat. No. 6,103,628 entitled "Reverse Linear Polisher With Loadable Housing".

This application is related to U.S. patent application Ser. No. 10/126,469 entitled "Single Drive System For A Bi-Directional Linear Chemical Mechanical Polishing Apparatus" attorney reference 042496/0293224 filed on the same day as this application in the United States Patent and Trademark Office.

FIELD OF THE INVENTION

The present invention relates to manufacture of semiconductor wafers and more particularly to a method and system of polishing pad tensioning in a chemical mechanical polishing apparatus.

DESCRIPTION OF THE RELATED ART

U.S. Pat. No. 6,103,628, assigned to the assignee of the present invention, describes a reverse linear chemical mechanical polisher, also referred to as bi-directional linear chemical mechanical polisher, that operates to use a bi-directional linear motion to perform chemical mechanical polishing. In use, a rotating wafer carrier within a polishing region holds the wafer being polished.

U.S. patent application Ser. No. 09/684,059, filed Oct. 6, 2000, which is a continuation-in-part of U.S. Pat. No. 6,103,628, describes various features of a reverse linear chemical mechanical polisher, including incrementally moving the polishing pad that is disposed between supply and receive spools.

While the inventions described in the above patent and application are advantageous, further novel refinements are described herein which provide for a more efficient drive system that creates the reverse linear (or bidirectional linear) motion.

SUMMARY OF THE INVENTION

The present invention offers many advantages, including the ability to efficiently produce reverse linear motion for a chemical mechanical polishing apparatus.

Another advantage of the present invention is to provide for the ability to efficiently produce bi-directional linear motion in a chemical mechanical polishing apparatus that also allows for the incremental movement of the polishing pad.

Another advantage of the present invention is the provision for a single casting that houses the polishing pad, including the supply spool, the receive spool, and pad path rollers.

The present invention provides the above advantages with a method and apparatus for producing bi-directional linear polishing that uses a flexible pad. In one aspect, a portion of the polishing pad is disposed under tension between a supply spool and a receive spool, with a motor providing the tension to either the supply spool or the receive spool and the other spool being locked during processing. If a new section of the polishing pad is needed, the same motor that provided the tension, if connected to the receive spool, is used to advance the polishing pad a determined amount. Further, during processing, a feedback mechanism is used to ensure that the tension of the polishing pad is consistently maintained.

BRIEF DESCRIPTION OF THE DRAWINGS

The above and other objectives, features, and advantages of the present invention are further described in the detailed description which follows, with reference to the drawings by way of non-limiting exemplary embodiments of the present invention, wherein like reference numerals represent similar parts of the present invention throughout several views and wherein.

DETAILED DESCRIPTION OF THE PREFERRED EMBODIMENT

Figure 1:
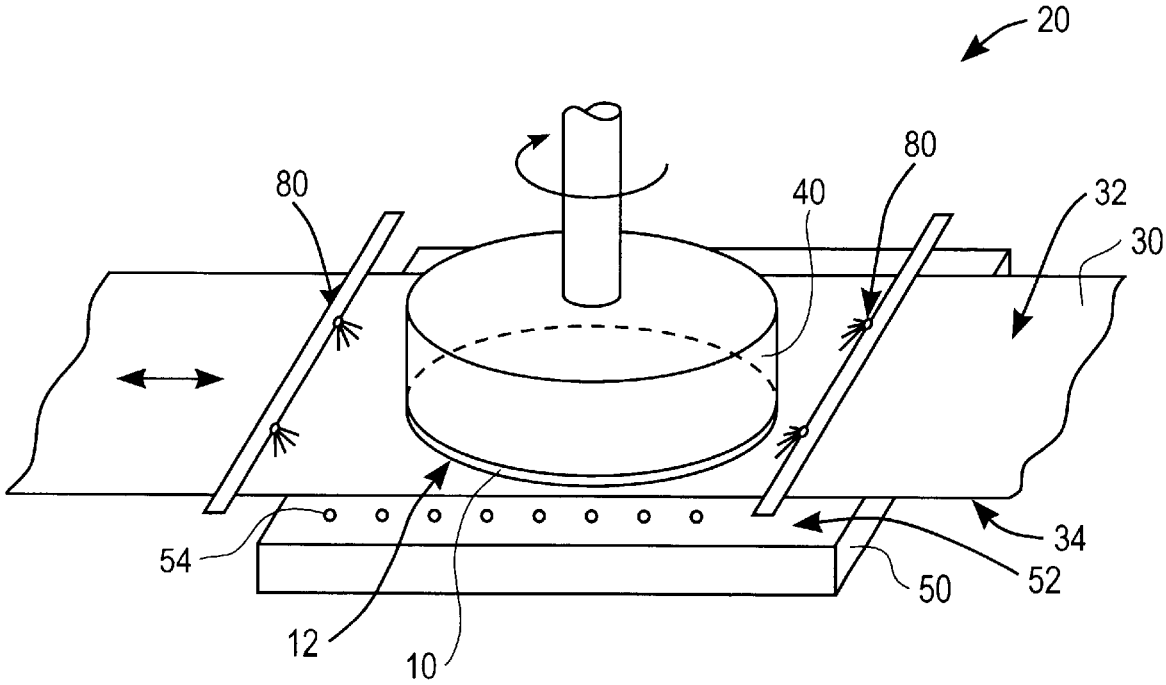
FIG. 1 illustrates a bi-directional linear polisher according to the present invention.

U.S. Pat. No. 6,103,628 and U.S. patent application Ser. No. 09/684,059, both of which are hereby expressly incorporated by reference, together describe, in one aspect, a reverse linear polisher that can use a polishing pad to polish a wafer. FIG. 1 illustrates a processing area 20 as described in the above references. A portion of the bidirectional linearly moving pad 30 for polishing a front wafer surface 12 of a wafer 10 within a processing area is driven by a drive mechanism. The wafer 10 is held in place by a wafer carrier 40 and can also rotate during a polishing operation as described herein.

Below the pad 30 is a platen support 50. During operation, due to a combination of tensioning of the pad 30 and the emission of a fluid, such as air, water, or a combination of different fluids from openings 54 disposed in the top surface 52 of the platen support 50, the bi-linearly moving portion of the pad 30 is supported above the platen support 50 in the processing area, such that a frontside 32 of the pad 30 contacts the front surface 12 of the wafer 10, and the backside 34 of the pad 30 levitates over the top surface 52 of the platen support 50. While the portion of the pad 30 within the processing area moves in a bi-linear manner, the two ends of the pad 30 are preferably connected to source and target spools 60 and 62 illustrated in FIGS. 2 and 3, respectively, allowing for incremental portions of the pad 30 to be placed into and then taken out of the processing area, as described in U.S. patent application Ser. No. 09/684,059 referenced above, as well as further hereinafter.

Further, during operation, various polishing agents without abrasive particles or slurries with abrasive particles can be introduced, depending upon the type of pad 30 and the desired type of polishing, using nozzles 80. For example, the polishing pad 30 can contain abrasives embedded in the frontside 32, and can be used with polishing agents but not a slurry being introduced, or with a polishing pad 30 that does not contain such embedded abrasives instead used with a slurry, or can use some other combination of pad, slurry and/or polishing agents. The polishing agent or slurry may include a chemical that oxidizes the material that is then mechanically removed from the wafer. A polishing agent or slurry that contains colloidal silica, fumed silica, alumina particles etc., is generally used with an abrasive or non-abrasive pad. As a result, high profiles on the wafer surface are removed until an extremely flat surface is achieved.

While the polishing pad can have differences in terms of whether it contains abrasives or not, any polishing pad 30 according to the present invention needs to be sufficiently flexible and light so that a variable fluid flow from various openings 54 on the platen support can affect the polishing profile at various locations on the wafer. Further, it is preferable that the pad 30 is made from a single body material, which may or may not have abrasives impregnated therein. By single body material is meant a single layer of material, or, if more than one layer is introduced, maintains flexibility such as obtained by a thin polymeric material as described herein. An example of a polishing pad that contains these characteristics is the fixed abrasive pad such as MVVR66 marketed by 3M company that is 6.7 mils (0.0067 inches) thick and has a density of 1.18 g/cm$^3$. Such polishing pads are made of a flexible material, such as a polymer, that are typically within the range of only 4–15 mils thick. Therefore, fluid that is ejected from the openings 54 on the platen support 50 can vary by less than 1 psi and significantly impact the amount of polishing that will occur on the front face 12 of the wafer 10 that is being polished, as explained further hereinafter. With respect to the pad 30, the environment that the pad 30 is used in, such as whether a linear, bi-linear, or non-constant velocity environment will allow other pads to be used, although not necessarily with the same effectiveness. It has been determined, further, that pads having a construction that has a low weight per cm$^2$ of the pad, such as less than 0.5 g/cm$^2$, coupled with the type of flexibility that a polymeric pad achieves, also can be acceptable.

Another consideration with respect to the pad 30 is its width with respect to the diameter of the wafer 10 being polished, which width can substantially correspond to the width of the wafer 10, or be greater or less than the width of the wafer 10.

As will also be noted hereinafter, the pad 30 is preferably substantially optically transparent at some wavelength, so that a continuous pad 30, without any cut-out windows, can allow for detection of the removal of a material layer (end point detection) from the front surface 12 of the wafer 10 that is being polished, and the implementation of a feedback loop based upon the detected signals in order to ensure that the polishing that is performed results in a wafer 10 that has all of its various regions polished to the desired extent.

The platen support 50 is made of a hard and machineable material, such as titanium, stainless steel or hard polymeric material. The machineable material allows formation of the openings 54, as well as channels that allow the fluid to be transmitted through the platen support 50 to the openings 54. With the fluid that is ejected from the openings 54, the platen support 50 is capable of levitating the pad. In operation, the platen support 50 will provide for the ejection of a fluid medium, preferably air, but water or some other fluid can also be used. This ejected fluid will thus cause the bi-linearly moving pad 30 to levitate above the platen support 50 and pushed against the wafer surface when chemical mechanical polishing is being performed.

A pad drive system 100 that is preferably used to cause the bi-linear reciprocating movement of the portion of the polishing pad within the processing area will now be described.

Figure 3:
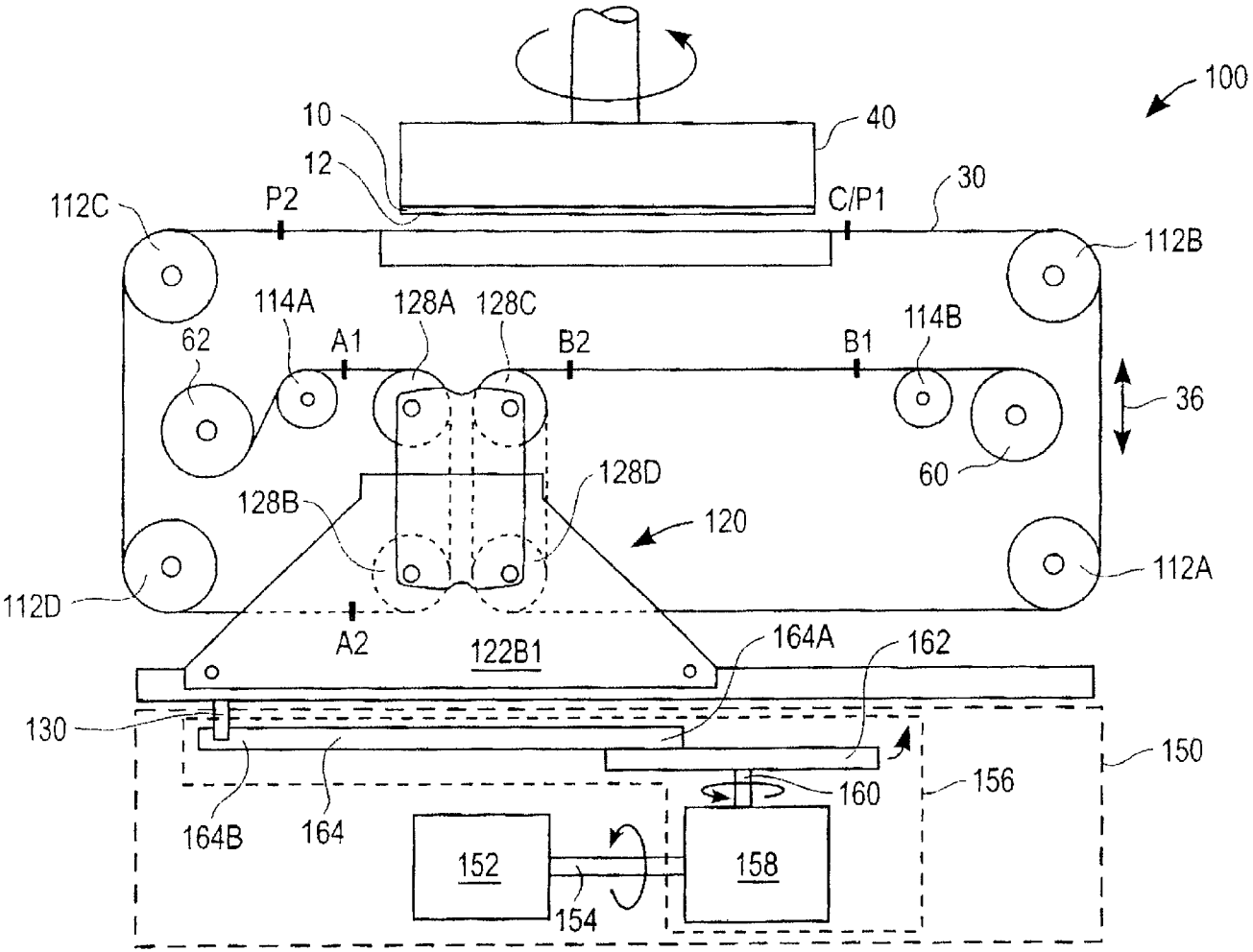
FIG. 3 illustrates a polishing pad path through components of the casting that provide for a processing area in which bi-directional linear motion of the polishing pad results.

As an initial overview, as illustrated by FIG. 3, a path 36 that the polishing pad 30 travels within the pad drive system 100 between the supply spool 60 and the receive spool 62 is illustrated. As shown, from the supply spool 60 and alignment roller 114B the path 36 includes passing through top 128C and then bottom 128D right slide rollers of the slide member 120, and then over each of rollers 112A, 112B, 112C and 112D in a rectangularly shaped path and then around each of the bottom 128B and then top 128A left slide rollers of the slide member 120, and then to the alignment roller 114A and receive spool 62. As is apparent from FIG. 3, and with reference to the points "A1, A2, B1, B2, and C, with the polishing pad 30 properly locked in position, preferably being attached between a supply spool 60 and the receive spool 62, horizontal bidirectional linear movement of the horizontal slide member 120 creates a corresponding horizontal bidirectional linear movement of a portion of the polishing pad. Specifically, for example, as the horizontal slide member 120 moves from right to left from position P1 to position P2, the point A1 on the pad 30 will remain in the same position relative to the receive spool 62, but the point A2 will have moved through the left side rollers 128A and 128B of the horizontal slide member 120. Similarly, the point B1 on the pad 30 will remain in the same position relative to the supply spool 60, and the point B2 will have moved through the right side rollers 128D and 128C of the horizontal slide member 120. As is apparent, by this movement, the point C will have moved linearly through the processing area. It is noted that the point C will move twice as far horizontally as compared to the horizontal movement of the horizontal slide member 120. Movement of the horizontal slide member 120 in the opposite direction will cause the point C of the polishing pad 30 to also move in the opposite direction. Thus, the portion of the polishing pad disposed within a polishing area (point C) of the chemical mechanical polishing apparatus can polish a top front surface of a wafer using the bidirectional linear movement of the portion of the polishing pad 30.

With the path 36 and the bi-linear pad movement mechanism having been described, a further description of the components within the path 36, and the horizontal movement drive assembly 150 associated therewith, will now be provided.

Figure 2:
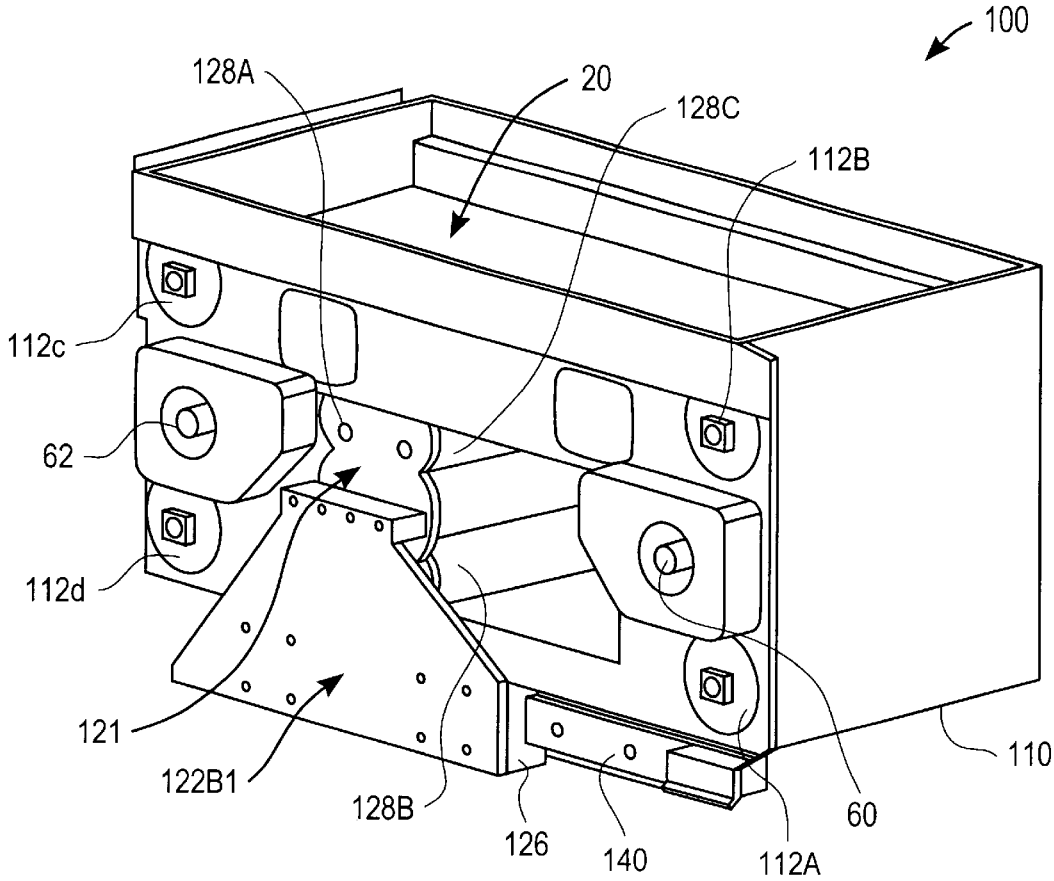
FIG. 2 illustrates a perspective view of a pad drive system that includes a horizontal slide member that is horizontally moveable over a stationary casting using drive components according to the present invention.
Figure 4:
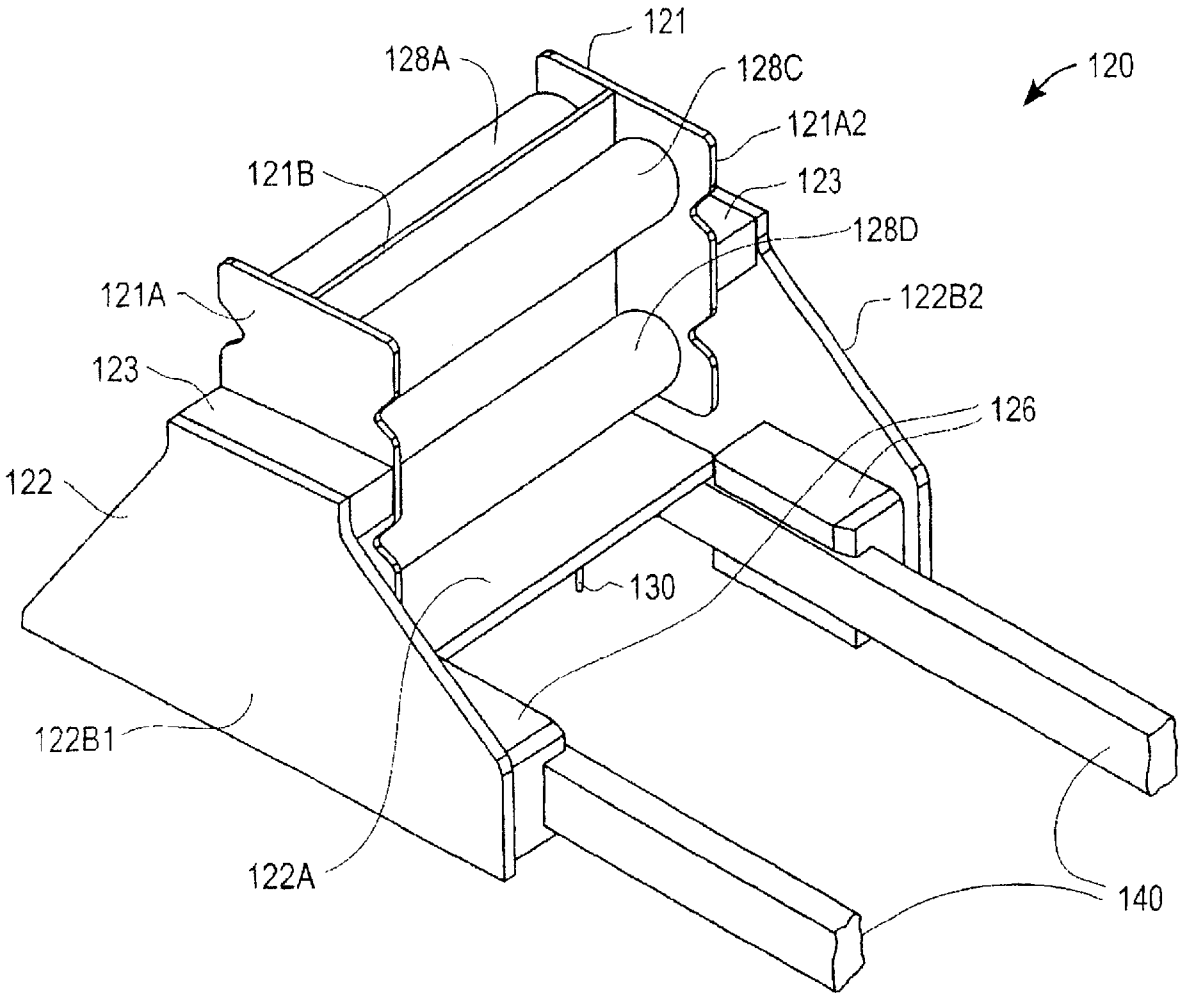
FIG. 4 illustrates a side view of a horizontal slide member and the drive system according to the present invention.

As illustrated in FIGS. 2 and 4, the horizontal slide member 120 is horizontally moveable over rails 140. The rails 140 are attached to a casting 110, made of a metal such as coated aluminum, which casting also has all of the other pad path generating components attached thereto as well. Thus, various openings within the casting 110 exist for the inclusion of these pad path components, including the supply spool 60 and the receive spool 62 (which are each attached to a spool pin associated therewith), as well as each of rollers 112A, 112B, 112C, 112D, 114A and 114B, as well as a large opening for a roller housing 121 and pin connection piece 122A that connect together the sidepieces 122B1 and 122B2 of the horizontal slide member 120. The rails 140, one on each side of the casting 110, provide a surface for mounting rails 140 on which the horizontal slide member 120 will move. As illustrated in FIG. 4, the horizontal slide member 120 is mounted on the rails 140 using carriage members 126. The carriage members 126 moveably hold the wafer in positions above and below the rail and can be used to reduce friction between the rails 140 and the horizontal slide member 120. The carriage members 126 may include sliding elements such as metal balls or cylinders (not shown) to facilitate sliding action of the horizontal sliding member 120.

With respect to the horizontal slide member 120, as illustrated in FIGS. 2 and 4, a support structure 122 is shaped with side-walls 122B1 and 122B2 with connecting piece 122A attached between them. The carrier members 126 are attached to the inner sides of the side-walls 122B1, 122B2. Further, the roller housing 121 is shaped with sidepieces 121A1 and 121A2, with a connecting piece 121B between them. The roller housing 121 is supported by the support structure 122. In this respect, side pieces 121A1 and 121A2 of the roller housing are attached to the side walls 122B1, 122B2 of the support structure 122, using support pieces 123. Attached between the two side pieces 121A1 and 121A2, in the vicinity of the connecting piece 121B, are four rollers 128A–D, with left side rollers 128A–B on one side of the connecting piece 121B and right side rollers 128C–D on the other side of the connecting piece 121B.

Furthermore, a pin 130 is downwardly disposed from the pin connection piece 122A as shown in FIG. 4, which pin 130 will connect to a link 164 associated with the horizontal drive assembly 150, described hereinafter. The horizontal drive assembly 150 will cause horizontal bid-directional linear movement of the pin 130, and therefore the horizontal bid-directional linear movement of entire horizontal slide member 120 along the rails 140.

The horizontal drive assembly 150, as shown in FIG. 3, is comprised of a motor 152 that will rotate shaft 154. Shaft 154 is connected to transmission assembly 156 that translates the rotational movement of the shaft 154 into the horizontal bi-directional linear movement of the horizontal slide member 120. In a preferred embodiment the transmission assembly 156 contains a gearbox 158 that translates the horizontal rotational movement of shaft 154 into a vertical rotational movement of shaft 160. Attached to shaft 160 is a crank 162 to which one end 164A of the link 164 is attached, with the other end 164B of the link 164 being attached to the pin 130, thereby allowing relative rotational movement of the pin 130 within the other end 164B of the link 164, which when occurring will also result in the horizontal bi-linear movement of the pin 130.

Thus, operation of the horizontal drive assembly 150 will result in the bi-directional linear movement of the horizontal slide member 120, and the corresponding horizontal bi-directional linear movement of a portion of the polishing pad 30 within the processing area.

As described in U.S. Application Ser. No. 10/126,469, entitled "SingleDrive System For A Bi-Directional Linear Chemical Mechanical Polishing Apparatus" attorney reference 042496/0293224 mentioned above, during processing the polishing pad can be locked in position between the supply spool 60 and the receive spool 62. As such, while a portion of the pad 30 within the processing area moves in the horizontal bi-directional linear manner, the pad can also be unlocked so that another portion of the polishing pad will move within the processing area, allowing incremental portions of the pad to be placed into and then taken out of the processing area, as describe in U.S. patent application Ser. No. 09/684,059 referenced above.

Figure 5A:
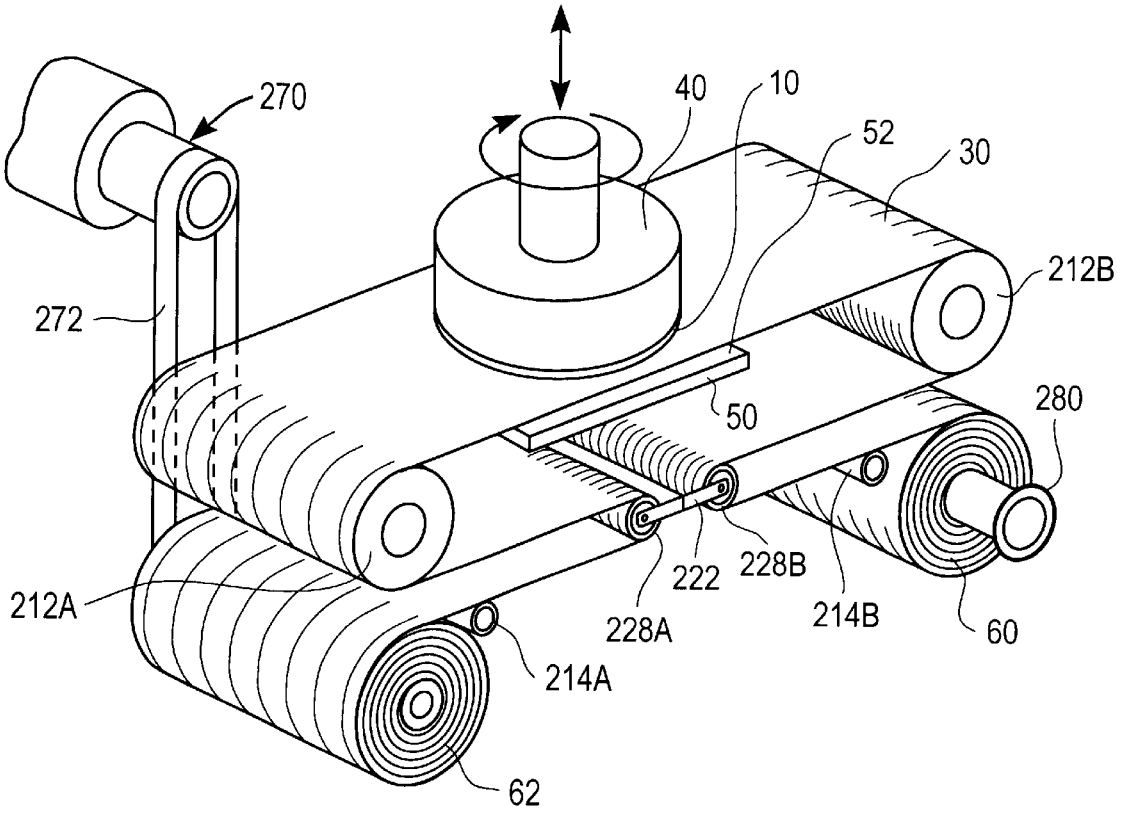
FIGS. 5A and 5B illustrate a tensioning and incrementing mechanism according to the present invention.
Figure 5B:
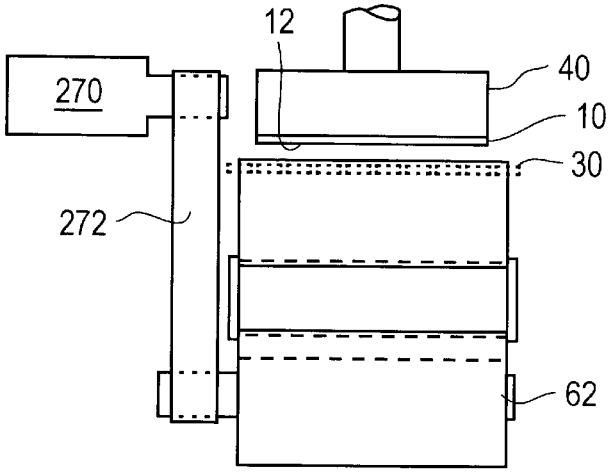

While have the pad 30 locked in position at both the supply spool 60 and the receive spool 62 will work, it has been found that more effective results can be achieved using a tensioning mechanism at one end of the portion of pad 30 in cooperation with the drive system described in the Drive System application referenced above. In particular, as illustrated in FIGS. 5A and 5B, a processing system is shown with only those parts needed for the present discussion, which includes a horizontal slide member 220 that includes rollers 228A and 228B that are connected together using an connector piece 222. The polishing pad 30 travels in a pad path 36 that is similar to that described previously with reference to FIG. 3, from the supply spool 60 and alignment roller 214B, through the horizontal slide member roller 228B, and then around both rollers 212B and 212A, to the horizontal slide member roller 228A, and then to the receive spool 62 via the alignment roller 214A. It should be noted, however, that this simplified version is not preferred, since a portion of the frontside of the pad 30 will touch the rollers 228A and 228B.

Further, as shown in FIGS. 5A and 5B, a belt 272 is connected between a tensioning and incrementing motor 270, which will be referred as the motor 270 hereinafter, and the receive spool 62. Further, a lock mechanism 280, such as a clamp mechanism, is illustrated. In this embodiment, tensioning of the pad may be obtained by locking the supply spool 60 using the lock mechanism 280 and activating the motor 270 with a predetermined torque value to rotate the receive spool 62 which is connected to the motor 270 through the belt 272. Further, incrementing of the pad is obtained by unlocking the lock mechanism to release the supply spool 60, and rotating the motor 270, preferably at a low rpm, until for example a used section of the pad is taken up by the receive spool 62, and a new pad section is brought over the processing area.

Figure 6:
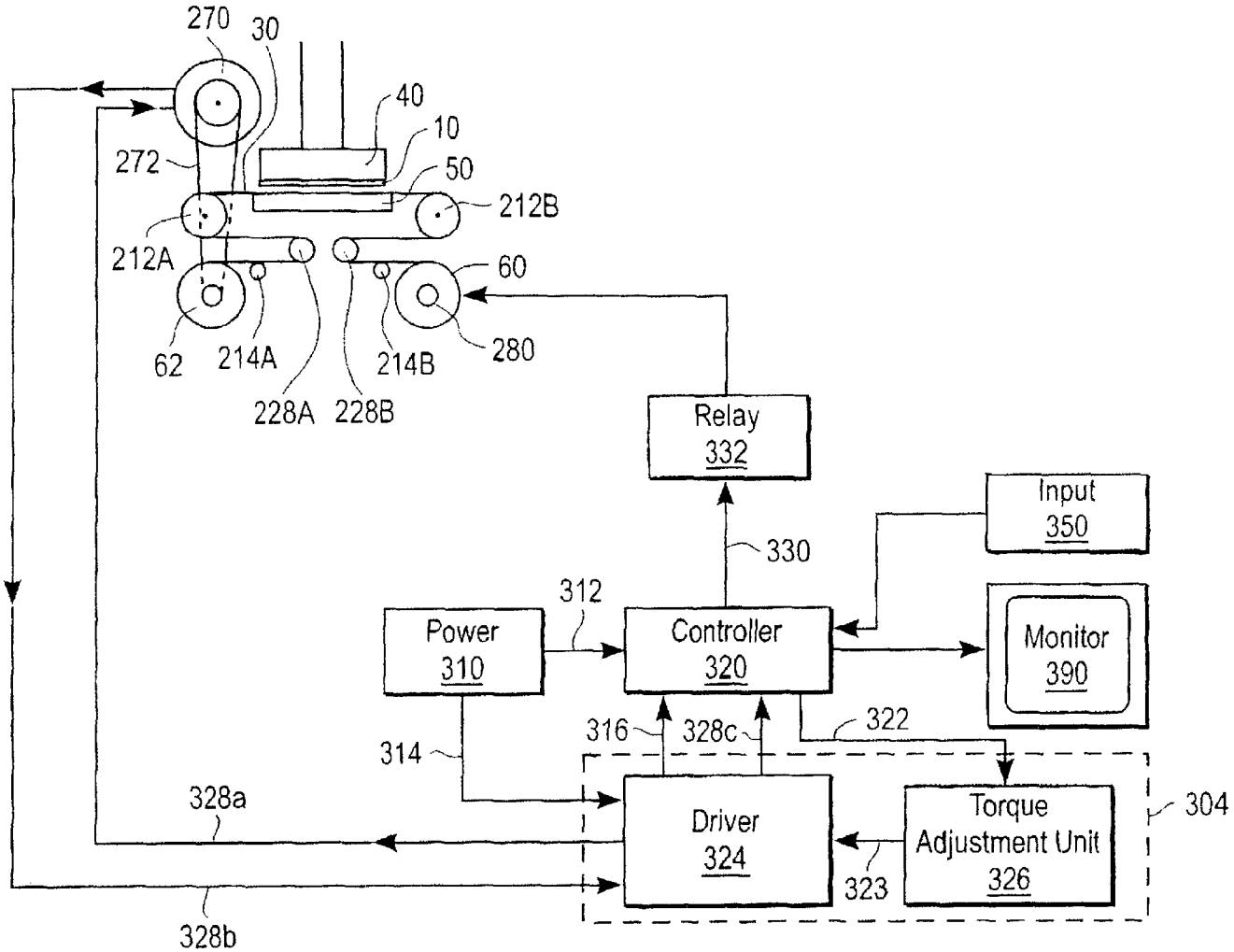
FIG. 6 illustrates the controller used to control the tensioning and incrementing mechanism according to the present invention.

The control system for controlling the tensioning and incrementing motor 270 and the lock mechanism 280 is illustrated in further detail in FIG. 6. As shown, power for the motor 270 and a controller 320 is provided by power source 310, which provides appropriate power along line 314 to a driver 324 and likely a different appropriate power along line 312 to controller 320. Controller 320 includes a computer or microcontroller of some type, as is known. Further, line 322 from the controller inputs the predetermined torque value to the motor control unit 304 as a TORQUE signal, specifically to torque control unit 326. The predetermined torque value for the motor 270 may be a torque value that is about 10% less than the rated torque value of the lock mechanism 280. The line 323 from the torque control unit inputs the TORQUE signal to the driver 324. Line 316 returns the TORQUE signal that is received from the driver 324 to the controller for feed-back or self-check purposes. If self-check is not desired, the line 316 is removed. As will be described hereinafter, the TORQUE signal is used to maintain the tension on the receive spool 62 at a desired level during processing. The driver 324, through the line 328*a,* applies this torque value to the motor 270 as electrical current.

If the pad needs to be incremented, however, with an appropriate signal from the controller, the motor 270 is rotated, preferably at a low rpm, and the pad is advanced. As the motor rotates, it generates predetermined number of encoder pulses per revolution. The encoder pulses generated by the motor 270 are fed back to the driver 324 through the line 328*b* and then from the driver 324 to the controller 320 through the line 328*c*. By counting the pulses, the controller 320 tracks the position of the pad, as it is advanced by the motor 270. In one example, a single revolution of the motor 270 advances the pad 280 millimeters. An exemplary motor may be Model no. SG255SA-GA05ACC which is available from Yaskawa Electric Co., Tokyo, Japan. In this particular example, the motor 270 generates 8192 pulses per revolution. These pulses are sent to the driver serially. However, encoder pulses are ignored by the controller when performing tensioning, because the motor 270 will try to rotate at a certain speed, but of course it will not be able to move since pad is constrained by the lock mechanism 280 on the supply spool.

Upon receipt of process sequence commands and external signals, such as the TORQUE signal discussed above, controller 320 will generate control signals along line 322 that are used by the motor control unit 304 to control the motor 270. In particular, the signals generated include an ON/OFF signal, as well as a TENSION signal that is used to supply the motor control unit 304 with an indication of the proper amount of power to supply to the motor 270 in order to achieve the desired tension on the receive spool 62 during processing. Controller 320 will also generate a BRAKE signal along line 330, which preferably passes through a relay 332 to the lock mechanism 280, which is preferably implemented as an electromagnetic clamp brake that is used to lock the supply spool 60 in position. A monitor 340 and a user-input device 350 such as a keyboard are also preferably connected to the controller 320.

The motor control unit 304 includes a driver 324 and a torque adjustment unit 326. Power supplied to the driver 324 is varied in dependence upon a signal that is generated by the torque adjustment unit 326.

Figure 7:
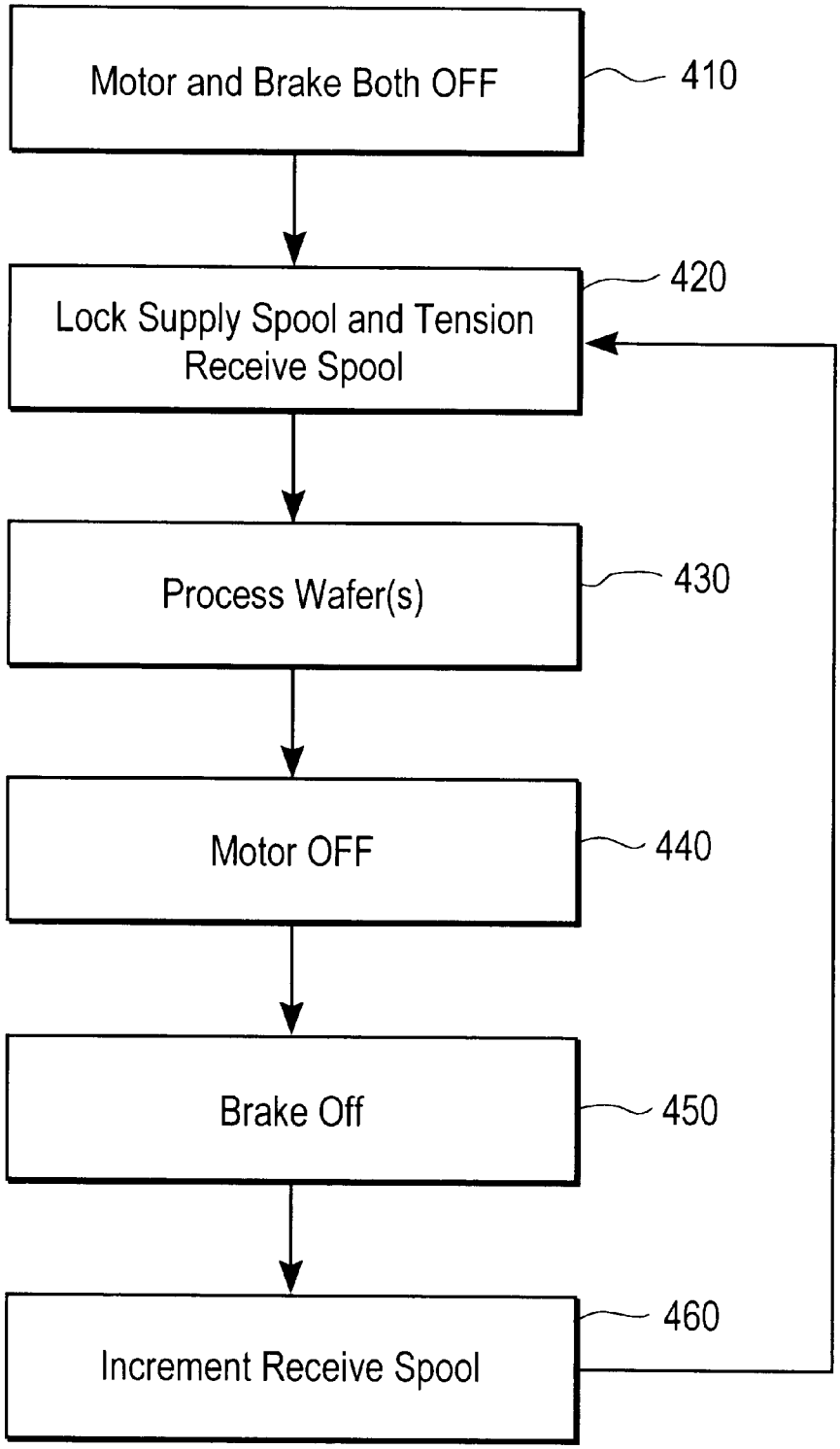
FIG. 7 illustrates a flowchart of preferred operation using the tensioning and incrementing mechanism according to the present invention.

Operation of the tensioning and incrementing of the portion of the pad 30 according to the present invention will now be further described with reference to the flowchart illustrated in FIG. 7, with reference to the other Figures discussed above.

As illustrated, during processing, initially in step 410, the controller 320 provides an OFF signal to both the motor control unit 304 and the lock mechanism 280. This causes both the supply spool 60 and the receive spool 62 to rotate freely, thereby allowing the initial threading of the pad 30 through the pad path 36 as described above with reference to FIG. 5A. Once threaded and processing is to occur, step 420 follows, at which time controller 320 provides an ON signal to the lock mechanism 280, followed by a TENSION signal to the motor control unit 304, which TENSION signal turns on the motor 270 and applies tension to the receive spool 62. Thus, the supply spool 60 becomes locked, and the receive spool 62 is held under tension, thereby appropriately tensioning the entire portion of the pad 30 therebetween, including that portion of the pad 30 that is in the processing area 20 illustrated in FIG. 1.

Thereafter, step 430 is begun and processing will occur. During processing, the controller 320 will initiate the bidirectional linear movement of the pad 30 using the pad drive system 100 discussed above with reference to FIG. 3 for example. During processing using a specific portion of the pad 30, typically some number of wafers 10 can be processed, which may result in the turning on and off of the pad drive system 100.

At some point, however, the portion of the pad 30 used for polishing will need to be replaced, and another portion of pad 30 provided. While an entirely new portion of pad 30 will be described as being provided, it will be understood that incremental portions can also be provided. When any new portion of pad 30 is needed from the supply spool 60, the same operation will apply. In particular, the controller 320 will first provide in step 430 an OFF signal to the motor control unit to signal that the motor 270 should be turned off. Thereafter follows step 440, in which an OFF signal will also be provided to the lock mechanism 280, thereby turning off the brake and unlocking the supply spool 60. Step 460 then follows, in which the controller 320 signals to the motor control unit 304 to increment the pad 30 some specified amount, which amount will correspond to the linear distance the pad 30 is desired to move. Upon this signal, the motor control unit 304 turns on the motor 270 and advances the pad by rotating the receive spool 62. As previously mentioned this specific amount that the pad is incremented may be determined through the encoder pulses generated by the rotating motor 270. Once the pad advancement occurs, step 420 is then initiated again, so that the supply spool 60 can be locked and the receive spool tensioned as described above.

The above provided description illustrates a preferred manner of providing tension during processing for the portion of the pad 30 that is in the processing area, as well as the incrementing of the pad 30, using the same motor 270. It is understood that although described as tensioning the receive spool 62 and locking the supply spool 60 during processing, that tensioning the supply spool 60 and locking the receive spool 62 during processing is another manner of implementing the present invention.

While the tensioning and incrementing is preferably accomplished using the single motor 270, it is understood that if two motors, one attached to the receive spool and the other to the supply spool, that a variety of arrangements for tensioning and incrementing would also exist.

Further, although various preferred embodiments have been described in detail above, those skilled in the art will readily appreciate that many modifications of the exemplary embodiment are possible without materially departing from the novel teachings and advantages of this invention.

What is claimed is:

1. A method of tensioning a portion of a polishing pad within a processing area comprising the step of:

providing a polishing pad having a portion disposed within a processing area, one end attached to a supply spool, and another end attached to a receive spool: locking one of the supply spool and the receive spool, such that movement of the corresponding end of the polishing pad will not occur; and tensioning the corresponding other end of the polishing pad from the other of the supply spool and the receive spool using a tensioning mechanism so that bi-linear movement of the portion of the polishing pad within the processing area using another drive mechanism occurs while the polishing pad is tensioned by the tensioning mechanism.

2. The method according to claim 1 wherein:

the step of locking locks the supply spool;

the step of tensioning tensions from the receive spool; and further including the step of incrementally moving the polishing pad so that another portion is disposed within the processing area, the step of incrementally moving using the tensioning mechanism to incrementally move the polishing pad.

3. The method according to claim 2 wherein the step of incrementally moving includes the steps of:

eliminating tension from the receive spool;

unlocking the supply spool; and incrementally moving the polishing pad using the tensioning mechanism while the supply spool is unlocked.

4. The method according to claim 2 wherein the step of tensioning includes the steps of:

continuously monitoring the tension applied to the polishing pad; and continuously adjusting the tension based upon the continuously monitored tension.

5. The method according to claim 4 wherein the step of continuously monitoring the tension monitors a current supplied to a motor that is used in the step of tensioning.

6. The method according to claim 4 wherein the step of tensioning uses the motor to tension to the receive spool and to incrementally move the polishing pad.

7. The method according to claim 6 wherein the step of providing further provides a plurality of rollers disposed on a slide member and another plurality of rollers.

8. The method according to claim 7 wherein the step of providing provides a pad path in which only a back surface of the polishing pad will physically contact the plurality of rollers and the another plurality of rollers.

9. The method according to claim 1 wherein the step of tensioning uses the motor to tension to the receive spool and to incrementally move the polishing pad.

10. The method according to claim 1 wherein the step of tensioning tensions an entire portion of the polishing pad disposed between the supply spool and the receive spool.

11. The method according to claim 1 wherein the pad path passes over the plurality of rollers and the another plurality of rollers.

12. The method according to claim 1 wherein the step of tensioning includes the steps of:

continuously monitoring the tension applied to the polishing pad; and continuously adjusting the tension based upon the continuously monitored tension.

13. The method according to claim 12 wherein the step of continuously monitoring the tension monitors a current supplied to a motor that is used in the step of tensioning.

14. The method according to claim 12 wherein the step of tensioning uses the motor to tension to the receive spool and to incrementally move the polishing pad.

15. An apparatus for tensioning and incrementing a portion of a polishing pad within a processing area used for chemical mechanical polishing of a workpiece using a solution comprising:

a drive assembly that contains a rotatable shaft;

a slide member that is moveable within a slide area, the slide member being mechanically coupled to the drive assembly, such that rotation of the rotatable shaft creates bi-linear movement of the slide member, wherein the polishing pad is disposed through the slide member, such that bi-linear movement of the slide member creates a corresponding bi-linear movement of the portion of the polishing pad; and a supply spool;

a receive spool;

a plurality of rollers that create a pad path between the supply spool and the receive spool; and a tensioning mechanism that provides tension to the receive spool, and thereby the portion of the polishing pad, when the portion of the polishing pad is being used to chemically mechanically polishing the workpiece.

16. The apparatus according to claim 15 wherein the tensioning mechanism is coupled to the receive spool.

17. The apparatus according to claim 16 further including a locking mechanism coupled to the supply spool.

18. The apparatus according to claim 17 further including a controller that controls the tension provided by the tensioning mechanism.

19. The apparatus according to claim 17 wherein the controller receives a feedback signal that assists in controlling the tension provided by the tensioning mechanism.

20. The apparatus according to claim 17 wherein the tensioning mechanism further provides for incrementing the polishing pad.

21. The apparatus according to claim 20 wherein the tensioning mechanism will increment the polishing pad when the locking mechanism unlocks the supply spool.

* * * * *